US008012342B2

(12) United States Patent
Kobayashi et al.

(10) Patent No.: US 8,012,342 B2
(45) Date of Patent: Sep. 6, 2011

(54) LUBRICANT BASE OIL AND METHOD OF PRODUCING THE SAME

(75) Inventors: Manabu Kobayashi, Toda (JP); Katsuaki Ishida, Toda (JP); Masayuki Saito, Toda (JP); Hiroshi Yachi, Toda (JP)

(73) Assignee: Japan Energy Corporation, Tokyo (JP)

( * ) Notice: Subject to any disclaimer, the term of this patent is extended or adjusted under 35 U.S.C. 154(b) by 727 days.

(21) Appl. No.: 10/583,154

(22) PCT Filed: Mar. 18, 2005

(86) PCT No.: PCT/JP2005/005014

§ 371 (c)(1),
(2), (4) Date: Jun. 16, 2006

(87) PCT Pub. No.: WO2005/090528

PCT Pub. Date: Sep. 29, 2005

(65) Prior Publication Data

US 2007/0138052 A1 Jun. 21, 2007

(30) Foreign Application Priority Data

Mar. 23, 2004 (JP) ..... 2004-083839
May 28, 2004 (JP) ..... 2004-159213

(51) Int. Cl.
*C10M 105/04* (2006.01)

(52) U.S. Cl. ..... 208/18; 208/19; 208/24; 208/133; 208/950

(58) Field of Classification Search ..... 508/110, 508/571; 208/112, 18, 27, 19, 24, 950
See application file for complete search history.

(56) References Cited

U.S. PATENT DOCUMENTS 3,709,817 A * 1/1973 Estes et al. ..... 208/112
4,832,819 A * 5/1989 Hamner ..... 208/27
5,643,440 A 7/1997 Borghard et al.
6,008,164 A * 12/1999 Aldrich et al. ..... 508/110
6,080,301 A 6/2000 Berlowitz et al.
6,165,949 A 12/2000 Berlowitz et al.
6,332,974 B1 12/2001 Wittenbrink et al.
6,420,618 B1 7/2002 Berlowitz et al.

(Continued)

FOREIGN PATENT DOCUMENTS

JP B 06-62960 8/1994

(Continued)

OTHER PUBLICATIONS

Maxwell; (1987); "Zeolite Catalysis in Hydroprocessing Technology"; Catalysis Today; 1(4); pp. 385-413.

(Continued)

*Primary Examiner* — Ellen McAvoy
*Assistant Examiner* — Chantel Graham
(74) *Attorney, Agent, or Firm* — Oliff & Berridge, PLC

(57) ABSTRACT

This invention relates to lubricant base oil having high viscosity indexes and low pour points, and particularly to lubricant base oil consisting essentially of a normal paraffin and an isoparaffin, wherein (a) an average carbon number Nc in one molecule is not less than 28 but not more than 40, and (b) an average branch number Nb in one molecule calculated from a ratio of $CH_3$ carbon to total carbon determined by $^{13}$C-NMR analysis and the average carbon number Nc in one molecule is not more than (0.2Nc−3.1) but not less than 1.5.

20 Claims, 2 Drawing Sheets

U.S. PATENT DOCUMENTS

| | | | | |
|---|---|---|---|---|
| 6,475,960 | B1 | 11/2002 | Berlowitz et al. | |
| 6,506,297 | B1 * | 1/2003 | Wittenbrink et al. | 208/18 |
| 2002/0086803 | A1 | 7/2002 | Berlowitz et al. | |
| 2003/0158055 | A1 * | 8/2003 | Deckman et al. | 508/571 |
| 2004/0045868 | A1 | 3/2004 | Germaine | |
| 2004/0079678 | A1 | 4/2004 | Germaine | |

FOREIGN PATENT DOCUMENTS

| | | |
|---|---|---|
| JP | A 10-510565 | 10/1998 |
| JP | B 2901047 | 3/1999 |
| JP | A 2002-523231 | 7/2001 |
| JP | A 2002-524605 | 8/2002 |
| JP | A 2002-524610 | 8/2002 |
| JP | A 2002-524611 | 8/2002 |
| JP | A 2002-538232 | 11/2002 |
| JP | A 2003-517495 | 5/2003 |
| WO | WO 02/070627 A2 | 9/2002 |
| WO | WO 02/070629 A1 | 9/2002 |

OTHER PUBLICATIONS

Japanese Office Action issued in Japanese Application No. 2006-511254 mailed Apr. 12, 2011, with English-language translation.

* cited by examiner

LUBRICANT BASE OIL AND METHOD OF PRODUCING THE SAME

This application is a U.S. National Phase application of PCT/JP2005/005014 filed Mar. 18, 2005, which claims priority to Japanese Patent Application No. 2004-083839, filed Mar. 23, 2004 and Japanese Patent Application No. 2004-159213 filed May 28, 2004. The disclosure of each of the prior applications is hereby incorporated by reference in its entirety.

TECHNICAL FIELD

This invention relates to lubricant base oil having high viscosity indexes and low pour points and suitable as raw materials for lubricant oil such as motor oil or the like and methods of producing the same.

BACKGROUND ART

Heretofore, the lubricant base oil was produced by using crude oil as a raw material. Recently, it is demanded to improve performances of motor oil (lubricant oil for automobile) and hence the lubricant base oil is required to have a high viscosity index and a low pour point. Also, it is required to reduce an influence of the lubricant oil on an environment. For this end, it is necessary to reduce sulfur content, nitrogen content, aromatic content and so on in the lubricant base oil. However, in case of using the crude oil as a raw material, it is difficult to reduce these contents. Nowadays, there is got a lot of attention on lubricant oil produced by a hydroisomerization of a Fischer-Tropsch synthetic wax being mainly composed of an isoparaffin and having substantially no aromatic content, naphthenic content, olefinic content, sulfur content, nitrogen content and so on as a raw material.

When the lubricant base oil is produced by using a normal paraffin such as Fischer-Tropsch synthetic wax or the like as a raw material, a step of removing the normal paraffin from oil produced by the hydroisomerization, i.e. a dewaxing step is usually conducted in order to sufficiently assure a low-temperature fluidity of the lubricant base oil (JP-B-6-62960). Therefore, as the isomerization sufficiently proceeds and the content of isoparaffin becomes large, the yield of the base oil at the dewaxing step increases.

DISCLOSURE OF THE INVENTION

However, when the Fischer-Tropsch synthetic wax is used as a raw material, the properties of the lubricant base oil such as viscosity index, pour point and the like are dependent on the molecular structure of ingredients contained in the base oil, so that there is a problem that if the molecular structure of the ingredients is not suitable, the satisfactory properties of the base oil are not obtained.

And also, there is a problem that when the severity of the isomerization is increased for improving the yield, an amount of light fractions increases with the progress of the isomerization and the yield of the base oil decreases drastically.

Furthermore, it is generally known that the viscosity index of the lubricant base oil becomes high as a branch of a paraffin chain becomes small. Therefore, when the severity of the isomerization is increased, there is a problem that the isomerization of the isoparaffin proceeds excessively in conjunction with the increase of the light fractions to lower the viscosity index of the produced lubricant base oil.

As a method of improving the yield of the lubricant base oil is considered a method wherein the normal paraffin survived without being subjected to the isomerization is added to the raw material for recycling. However, when the residual paraffin lightened as compared with a starting straight-chain hydrocarbon material is subjected to the isomerization under the same conditions as in the starting straight-chain hydrocarbon material, there is a problem that the properties of the lubricant base oil lower.

It is, therefore, an object of the invention to provide lubricant base oil having a high viscosity index and a low pour point and suitable as a raw material for lubricant oil such as motor oil or the like as well as a method of producing the same.

The inventors have noticed that since the isoparaffin constituting the lubricant base oil does not develop the fluidity at a low temperature unless it has enough branches or dose not provide the sufficient viscosity index if it has excessive branches, lubricant base oil having desired properties can be obtained by controlling the branching number of the isoparaffin to a certain specified range and also it is required to have a sufficiently high molecular weight for providing a sufficient kinematic viscosity.

Moreover, the components of the lubricant oil are often composed of hydrocarbon compounds having a boiling point of not lower than 360° C. and a high carbon number. Since the number of structural isomers is large, it is difficult to identify the structures of the components by an analytical method such as a gas chromatography or the like. Therefore, it is difficult to determine how many branches the lubricant base oil produced by the isomerization of the Fischer-Tropsch synthetic wax has, and it is also difficult to select an optimum starting wax and set conditions of the isomerization in order to produce the lubricant base oil having a proper branching number.

Now, the inventors found that the average value of the branching number in the lubricant base oil can be determined by analyzing results of $^{13}$C-NMR analysis in detail and also found that the average branch number determined by this method, the carbon number of the starting wax and the conditions of the isomerization correlate with the properties of the lubricant base oil such as viscosity index and the like, and as a result the invention has been accomplished.

That is, the lubricant base oil according to the invention consists essentially of a normal paraffin and an isoparaffin, and satisfies the following requirements (a) and (b):

(a) an average carbon number Nc in one molecule is not less than 28 but not more than 40; and (b) an average branch number Nb in one molecule, which is derived from a ratio of $CH_3$ carbon to total carbon determined by $^{13}$C-NMR analysis and the average carbon number Nc in one molecule is not more than (0.2Nc−3.1) but not less than 1.5. The range of the average branch number Nb in one molecule and of the average carbon number Nc in one molecule is shown in FIG. 1.

In a preferable embodiment of the invention, the lubricant base oil is obtained by an isomerization of a starting straight-chain hydrocarbon material having an average carbon number Nc in one molecule of not less than 25. Also, the starting straight-chain hydrocarbon material is more preferably a Fischer-Tropsch synthetic wax.

A method of producing lubricant base oil according to the invention comprises subjecting starting oil made of a Fischer-Tropsch synthetic wax having a 10% distillation temperature of not lower than 360° C. to an isomerization under a condition that a decreasing ratio of a fraction having a boiling point of not lower than 360° C. is not more than 40% by weight.

Furthermore, the inventors found that both the yield and the viscosity index of the lubricant base oil can be simultaneously improved by hydroisomerization of the starting straight-chain hydrocarbon material, isolating a normal paraffin from the resulting oil and again hydroisomerization of only the isolated normal paraffin, and as a result the invention has been accomplished.

That is, another method of producing lubricant base oil according to the invention comprises the following steps:

(1) hydroisomerizing a starting straight-chain hydrocarbon material in a first reactor;

(2) separating oil obtained by the hydroisomerization into a fraction mainly composed of a normal paraffin (fraction α) and a fraction mainly composed of an isoparaffin (fraction β);

(3) hydroisomerizing the fraction α in a second reactor, and mixing oil obtained from the hydroisomerization (fraction γ) with the fraction β.

In a preferable embodiment of the production method of the invention, the hydroisomerization in the second reactor is carried out under a reaction condition that a decreasing ratio of a fraction having a boiling point of not lower than 360° C. in the hydroisomerization at the second reactor is made lower than a decreasing ratio of a fraction having a boiling point of not lower than 360° C. in the hydroisomerization at the first reactor. Since the fraction α fed to the second reactor is usually lightened as compared with the starting straight-chain hydrocarbon material fed to the first reactor, the yield and the properties of the lubricant base oil can be further improved by making the conditions of the hydroisomerization at the second reactor mild.

In another preferable embodiment of the production method of the invention, the starting straight-chain hydrocarbon material is a Fischer-Tropsch synthetic wax. Since the Fischer-Tropsch synthetic wax does not contain sulfur content, nitrogen content, aromatic content and so on as previously mentioned, high grade lubricant base oil can be produced. In this case, the Fischer-Tropsch synthetic wax is preferable to have an average carbon number Nc of not less than 25.

In the other preferable embodiment of the production method of the invention, the hydroisomerization in the first reactor is carried out under a reaction condition that a decreasing ratio of a fraction having a boiling point of not lower than 360° C. is not more than 50% by weight. In this case, the lubricant base oil having higher performances can be obtained.

The catalyst used in the hydroisomerization is not particularly limited, but is preferably a catalyst for the isomerization of the wax disclosed in Japanese Patent 2,901,014, in which at least one metal component selected from metals of Group 8 and Group 6β in the periodic table is supported on a carrier obtained by mixing alumina with 1-80% by weight of a crystalline molecular sieve having pores with a major axis of 6.5-7.5 Å and a $SiO_2/Al_2O_3$ molar ratio of not less than 50. Moreover, 1-80% by weight of silica gel may be added to the catalyst carrier.

The lubricant base oil according to the invention consists essentially of normal paraffin and isoparaffin and the given range of average carbon number and average branch number in one molecule, so that the pour point is low and the viscosity index is high and aromatic content, olefin content, sulfur content, nitrogen content and so on are not substantially included. According to the condition of production, small amount of naphthene content might be found in lubricant base oil, however, the amount is low and, therefore, the effects on lubricant base oil properties are limited. Such lubricant base oil can be produced by using the Fischer-Tropsch synthetic wax having a 10% distillation temperature of not lower than 360° C. to conduct isomerization under a condition that the decreasing ratio of a fraction having a boiling point of not lower than 360° C. is not more than 40% by weight.

Furthermore, in the production of the lubricant base oil from the starting straight-chain hydrocarbon material, the normal paraffin is isolated from the oil obtained by the hydroisomerization of the starting straight-chain hydrocarbon material and only the isolated normal paraffin is secondarily subjected to the isomerization, whereby the lubricant base oil having a higher viscosity index can be produced in a high yield.

Particularly, as the isolated normal paraffin is more lightened than the starting straight-chain hydrocarbon material, the yield and the properties of the lubricant base oil can be further improved by carrying out the isomerization in the second reactor under a condition milder than a severity of the isomerization in the first reactor.

Figure 1:
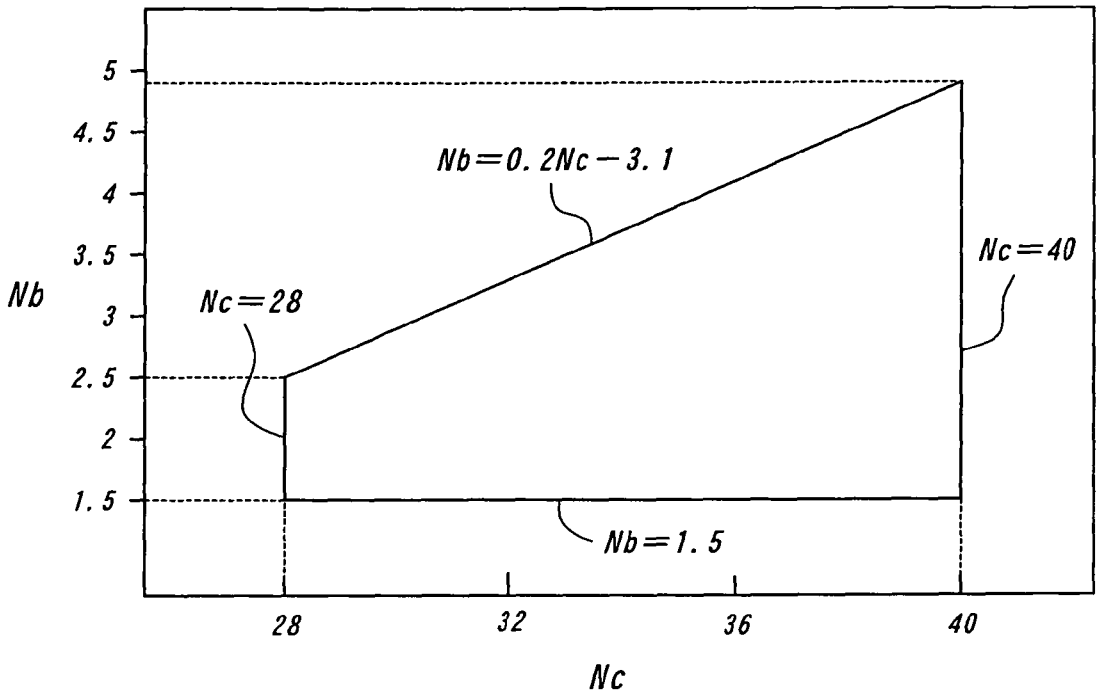
FIG. 1 is a view showing a range of an average branch number in one molecule and an average carbon number in one molecule of the lubricant base oil according to the invention.

BEST MODE FOR CARRYING OUT THE INVENTION (Starting Straight-Chain Hydrocarbon Material)

The inventors discovered that the lubricant base oil having high performances can be produced by using a heavy straight-chain hydrocarbon, especially a heavy Fischer-Tropsch synthetic wax. As a starting straight-chain hydrocarbon material used in the production method of the invention, therefore, is preferable starting oil obtained by previously removing a light fraction through distillation or the like, more preferably a starting material having an initial boiling point of not lower than 300° C., particularly a starting material having an initial boiling point of not lower than 320° C. Also, a starting material having a 10% distillation temperature of not lower than 380° C. is preferable, and a starting material having a 10% distillation temperature of not lower than 400° C. is more preferable.

The content of straight-chain hydrocarbon in the starting straight-chain hydrocarbon material is preferably not less than 85% by mass, more preferably not less than 95% by mass. As a content of impurity in the starting straight-chain hydrocarbon material, the content of sulfur-containing compounds is preferably not more than 500 ppm, more preferably not more than 50 ppm, and the content of nitrogen-containing compounds is preferably not more than 100 ppm, more preferably not more than 10 ppm.

As the starting straight-chain hydrocarbon material can be preferably used ones having the above-described properties. The starting straight-chain hydrocarbon material includes, but not be limited to, a slack wax obtained from a petroleum refinery process such as a solvent dewaxing process which is one of the production process for making the lubricant oil, a synthetic wax made by the Fischer-Tropsch process, α-olefin obtained by the polymerization of ethylene and the like. Although these waxes have many grades, they may be used alone or in a mixture of one or more, or a mixture of the slack wax and the synthetic wax may be also used. In the production method of the lubricant base oil according to the invention, it is preferable to use the synthetic wax made by the Fischer-Tropsch process alone. Further, the Fischer-Tropsch synthetic wax is preferable to have an average carbon number of not less than 25. Moreover, the Fischer-Tropsch process is a method of mainly synthesizing the straight-chain hydrocarbon by reacting carbon monoxide and hydrogen with a catalyst, and can also prepare little olefin, alcohol and so on.

(Isomerization of Starting Oil)

The isomerization performed in the production method of the invention is preferably a hydroisomerization. The hydroisomerization is a reaction in which the starting oil is contacted with a hydroisomerization catalyst in the presence of hydrogen, and is carried out under reaction conditions that a reaction temperature is preferably 300-400° C., more preferably 325-365° C., and a hydrogen pressure is preferably 1-20 MPa, more preferably 3-9 MPa, and a ratio of hydrogen/oil is preferably 100-2000 NL/L, more preferably 800-1800 NL/L, and a liquid hourly space velocity (LHSV) is preferably 0.3-5 $hr^{-1}$.

And also, the inventors discovered that when a conversion of the starting straight-chain hydrocarbon material is low, the average branch number of the isoparaffin (branched saturated hydrocarbon) is low and the resulting lubricant base oil develops high performances. The conversion of the starting straight-chain hydrocarbon material correlates with a so-called hydrocracking rate, and when the 10% distillation temperature of the starting oil is not lower than 360° C., the lubricant base oil having higher performances can be obtained by making a decreasing ratio of a fraction having a boiling point of not lower than 360° C. to not more than 40% by weight, particularly not more than 30% by weight. In case that the yield of the lubricant base oil is low because the amount of the unreacted normal paraffin survived by one hydroisomerization is much, the normal paraffin may be isolated at the dewaxing step after the hydroisomerization and the isolated normal paraffin may be recycled as a starting material for the hydroisomerization.

Furthermore, after the starting straight-chain hydrocarbon material is once hydroisomerized (first hydroisomerization), the normal paraffin is isolated from the resulting oil (separation of the normal paraffin and the isoparaffin) and only the normal paraffin is again isomerized (second hydroisomerization), whereby the yield and the viscosity index of the lubricant base oil can be simultaneously improved.

Figure 2:
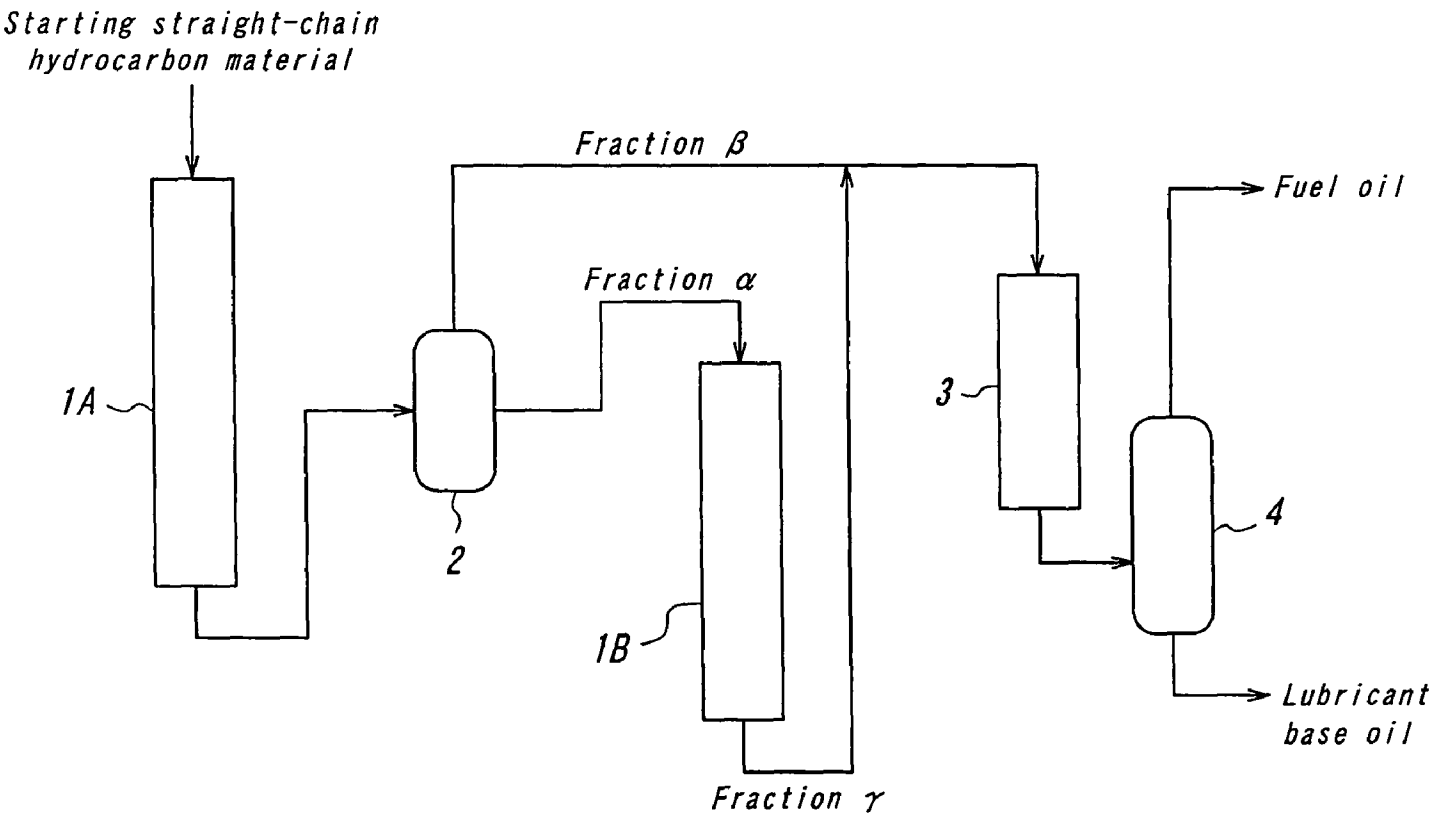
FIG. 2 is a flow chart showing an embodiment of the method of producing lubricant base oil according to the invention.

A preferable method of producing the lubricant base oil according to the invention is explained in detail with reference to FIG. 2. In FIG. 2 is shown a flow chart of an embodiment of the method of producing the lubricant base oil according to the invention. In the production of the lubricant base oil shown in FIG. 2, the starting straight-chain hydrocarbon material is fed to a first reactor 1A to conduct hydroisomerization at a step (1); oil obtained by the hydroisomerization of the step (1) is separated into a fraction mainly composed of a normal paraffin (fraction α) and a fraction mainly composed of an isoparaffin (fraction β) in a separation tank 2 at a step (2); the fraction α separated at the step (2) is fed to a second reactor 1B to conduct hydroisomerization, and oil obtained by the hydroisomerization in the second reactor 1B (fraction γ) is mixed with the fraction β separated at the step (2) in a step (3). The mixture of the fraction γ and the fraction β is dewaxed in a dewaxing reactor 3 and then separated into lubricant base oil and fuel oil at a distillation tower 4. Moreover, the production method of the illustrated embodiment comprises the step of dewaxing the mixture of the fraction γ and the fraction β and the step of distilling the oil obtained at the dewaxing step, but the production method of the lubricant base oil according to the invention may not comprise these dewaxing step and distilling step.

(First Hydroisomerization of Starting Straight-Chain Hydrocarbon Material)

The first hydroisomerization is preferable to be carried out under reaction conditions that the reaction temperature is preferably 300-400° C., more preferably 320-370° C., the hydrogen pressure is preferably 1-20 MPa, more preferably 3-9 MPa, the hydrogen/oil ratio is preferably 100-2000 NL/L, more preferably 300-1500 NL/L, and the liquid hourly space velocity (LHSV) is preferably 0.3-5 $hr^{-1}$. Also, the inventors discovered that when the conversion of the starting straight-chain hydrocarbon material is low, the average branch number of the isoparaffin is low and the resulting lubricant base oil develops higher performances. In this case, the conversion of the starting straight-chain hydrocarbon material is shown by a decreasing ratio of a fraction having a boiling point of not lower than 360° C., and concretely the decreasing ratio of the fraction having a boiling point of not lower than 360° C. is preferably not more than 50% by weight, more preferably not more than 40% by weight. When the decreasing ratio of the fraction having a boiling point of not lower than 360° C. at the first hydroisomeriation is not more than 40% by weight, the lubricant base oil having higher performances is particularly obtained. Moreover, in order to accurately evaluate the progressing degree of the isomerization, it is required to consider not only the ratio of the isoparaffin and the normal paraffin but also the branching degree of the isoparaffin, but the progressing degree can be practically controlled by the degree of the hydrocracking proceeding with the isomerization.

(Separation of Normal Paraffin and Isoparaffin)

In the oil obtained by the hydroisomerization are mixedly existent the normal paraffin and the isoparaffin. In the production method of the lubricant base oil according to the invention, the separation of the normal paraffin and the isoparaffin in the oil is performed for proceeding the isomerization of the normal paraffin while controlling the branching of the isoparaffin at minimum. In this case, the separation of the normal paraffin and the isoparaffin is not particularly limited, but a solvent dewaxing process can be used. When a heavy normal paraffin is removed by the solvent dewaxing process, 400 parts by weight of a mixed solution of methyl ethyl ketone and toluene at a weight ratio of 1:1 is first added to 100 parts by weight of the oil obtained by the hydroisomerization, which is held at 50° C. and sufficiently agitated and then cooled down to −29° C. The cooled slurry liquid is filtered under suction, and the resulting filtrate is distilled under a reduced pressure to remove methyl ethyl ketone and toluene, whereby a fraction having no normal paraffin can be obtained. Alternately, the normal paraffin and the isoparaffin may be separated by a membrane separation method using a membrane such as a zeolite membrane of a MFI structure or the like. Furthermore, the normal paraffin and the isoparaffin may be separated by an adsorptive separation method such as urea adduct method (Nikko method), Molex method, TSF method, isosieve method, Esso method or the like.

(Second Hydroisomerization of Starting Straight-Chain Hydrocarbon Material Oil)

The second hydroisomerization may be conducted in the same manner as in the first hydroisomerization, and concretely it is preferable to be carried out under reaction conditions that the reaction temperature is preferably 300-400° C., more preferably 310-350° C., the hydrogen pressure is preferably 1-20 MPa, more preferably 3-9 MPa, the ratio of hydrogen/oil is preferably 100-2000 NL/L, more preferably 300-1500 NL/L, and the liquid hourly space velocity (LHSV)

is preferably 0.3-5 $hr^{-1}$. In this case, it is preferable to conduct the second hydroisomerization under conditions milder than those of the first hydroisomerization considering that the normal paraffin fed to the second reactor is lighter than the starting straight-chain hydrocarbon material fed to the first reactor.

(Catalyst for Hydroisomerization)

The catalyst for hydroisomerization used in the production method of the invention is not particularly limited, but a solid isomerization catalyst is preferably used. As the solid isomerization catalyst can be concretely used a catalyst for the isomerization of a wax disclosed in Japanese Patent 2,901,047 and a hydrocracking catalyst disclosed in JP-A-2002-523,231. As the hydrocracking catalyst is preferably used a catalyst in which an active metal for hydrogenation is supported on a carrier inclusive of an inorganic porous oxide showing a solid acidity such as molecular sieve or the like. Moreover, the hydrocracking proceeds together with the isomerization in such a hydroisomerization. The hydroisomerization catalyst is preferable to be used for the hydroisomerization after the active metal for the hydrogenation is turned into a metal sulfide by a so-called sulfurization treatment.

As the inorganic porous oxide showing the solid acidity are silica, silica-alumina, molecular sieves and so on. As the molecular sieve is preferably used a crystalline molecular sieve having pores with a major axis of 6.5-7.5 Å and a $SiO_2/Al_2O_3$ molar ratio of not less than 50, particularly 100-500. Although an amorphous silica-alumina and a crystalline silica-alumina can be used as the silica-alumina, the amorphous one is preferably used. The amorphous silica-alumina is preferable to have a $SiO_2/Al_2O_3$ molar ratio of 3-8. Most preferably, the inorganic porous oxide comprises both the crystalline molecular sieve and the silica-alumina. The content of the inorganic porous oxide showing the solid acidity is preferable to be within a range of 1-60% by weight, more preferably 10-30% by weight to the catalyst, and it is preferable to use alumina as a binder in the residue of the carrier. It is preferable that the carrier does not contain an oxide other than the oxide containing aluminum or silicone as a constitutional element, but it may contain a magnesia, a zirconia, a boria or a calcia. The content of silicon in the catalyst is preferably within a range of 1-20% by weight, particularly 2-10% by weight as a silicon element weight.

As the crystalline molecular sieve having a major axis of pore of 6.5-7.5 Å can be used a zeolite L, a zeolite Y, a zeolite Ω, a mordenite, a silico-alumino-phosphate (SAPO) as a zeolite analogous compound and so on. Moreover, the zeolites and zeolite analogous compounds other than the zeolite Y are preferable because the zeolite Y has pores having a pore size of 7.4 Å but brings about a secondary hydrocracking due to the channel structure thereof.

As the crystalline molecular sieve is preferably used ones having a lower acidity, i.e. ones having a $SiO_2/Al_2O_3$ molar ratio of not less than 50. When the $SiO_2/Al_2O_3$ molar ratio of the crystalline molecular sieve is less than 50, even if it is added at a small amount, the hydrocracking activity is too high and hence the yield of the lubricant base oil becomes low, and also only the lubricant base oil having a low viscosity index may be obtained, or a deactivation of the catalyst due to the deposition of a coke or the like becomes conspicuous and a catalyst life may be shortened.

The shape of the crystalline molecular sieve is not particularly limited, but it is preferable to have a median diameter of not more than 100 μm, more preferably 0.1-50 μm. The amount of the crystalline molecular sieve added to the total catalyst is preferably 1-60% by weight, more preferably 1-30% by weight. When the amount of the crystalline molecular sieve is less than 1% by weight, the activity of the isomerization is low, while when it exceeds 60% by weight, the hydrocracking activity is high and the selectivity of the isomerization becomes low. Moreover, the molecular sieve function and the acidity of the crystalline molecular sieve are sufficiently developed even if the addition amount is small as long as it is within the above range. Furthermore, when the addition amount of the crystalline molecular sieve to alumina is made relatively small, it is possible to use a base metal of Group 8 and a metal of Group 6β as a metal component for hydrogenation.

The metal supported on the carrier is not particularly limited, but there can be used one or more of metals of Group 8 and Group 6β in the periodic table such as nickel, cobalt, molybdenum, tungsten and the like, which are metal components for hydrogenation generally used in a hydrofinishing catalyst. The amount of these metals supported is preferably within a range of 3-30% by weight as a total amount of metal components to the catalyst, more preferably within a range of 10-20% by weight. Moreover, other element such as phosphorous or the like may be supported together with the above-mentioned metal components, in which the amount of the other element such as phosphorous or the like is preferably within a range of 1-7% by weight.

(Dewaxing of Residual Wax Fraction)

A residual wax fraction (normal paraffin fraction) in oil obtained by the isomerization of the starting oil deteriorates the pour point of the lubricant base oil, so that it is preferable to remove the residual wax fraction by a dewaxing treatment. As the dewaxing treatment can be used a solvent dewaxing method and a catalytic dewaxing method using a dewaxing catalyst.

When the wax fraction is removed by the solvent dewaxing method, 100 parts by weight of the oil is first added and mixed with 200-800 parts by weight of a dewaxing solvent and cooled, from which the wax fraction is filtered off and the dewaxing solvent is separated by the distillation or the like, whereby dewaxed oil can be obtained. As the dewaxing solvent can be used a mixed solution of methyl ethyl ketone and toluene, propane and so on. Also, the cooling temperature is preferably within a range of −10 to −50° C., more preferably within a range of −20 to −40° C.

When the wax fraction is removed by the catalytic dewaxing method, the oil is contacted with the dewaxing catalyst in the presence of hydrogen and an undesired fraction is removed by the distillation or the like, if necessary, whereby the dewaxed oil can be obtained. As the dewaxing catalyst is preferably used a catalyst containing a molecular sieve. The molecular sieve is not particularly limited, but it is preferable to contain a MFI type zeolite. The MFI type zeolite has linear pores of 0.56 nm×0.53 nm and zigzag pores of 0.55 nm×0.51 nm, in which the normal paraffin is selectively diffused into the pores, so that it is known to show a high dewaxing reactivity [see I. E. Maxwell, Catal. Today 1: 385-413 (1987)].

(Fractional Distillation of Dewaxed Oil)

The undesired fraction is separated from the dewaxed oil obtained by the dewaxing treatment through the distillation or the like, if necessary, whereby the lubricant base oil is obtained. Usually, a fraction of not lower than 350° C. is used as lubricant base oil, and a 10% distillation temperature thereof is within a range of 350-400° C.

(Lubricant Base Oil)

The lubricant base oil of the invention consists essentially of a normal paraffin and an isoparaffin, wherein (a) an average carbon number Nc in one molecule is not less than 28 but not more than 40 and (b) an average branch number Nb in one molecule which is derived from a ratio of $CH_3$ carbon to total carbon determined by $^{13}C$-NMR analysis and the average carbon number Nc in one molecule is not more than (0.2Nc−3.1) but not less than 1.5.

In the lubricant base oil of the invention, the total content of the normal paraffin and the isoparaffin is preferably not less than 80% by weight, more preferably not less than 90% by weight, particularly not less than 95% by weight. The average carbon number Nc in one molecule is preferably not less than 29 but not more than 35. The average branch number Nb in one molecule is preferably not more than (0.2Nc−3.1) but not less than 2.0. The viscosity index is preferably within a range of 140-180, more preferably within a range of 145-170. The pour point is preferably within a range of 0 to −50° C., more preferably within a range of −10 to −40° C.

The lubricant base oil of the invention is preferably obtained by the isomerization of a starting straight-chain hydrocarbon material having an average carbon number Nc in one molecule of not less than 25, preferably not less than 25 but not more than 35. Furthermore, the starting straight-chain hydrocarbon material is preferably a Fischer-Tropsch synthetic wax. A kinematic viscosity at 40° C. is preferably within a range of 14-40 $mm^2/s$, more preferably within a range of 17-25 $mm^2/s$. A kinematic viscosity at 100° C. is preferably within a range of 3-10 $mm^2/s$, more preferably within a range of 4-8 $mm^2/s$.

The lubricant base oil of the invention forms lubricant oil as it is, or when it is mixed with another lubricant base oil and compounded with other adequate additives. As such lubricant oil are mentioned engine oil for automobile, gear oil for automobile and the like.

(Method of Calculating an Average Carbon Number of Lubricant Base Oil)

The average carbon number Nc can be determined from a value of an average molecular weight determined according to ASTM D2502-92. Also, a retention time of isoparaffin in a gas chromatography such as a distillation gas chromatography or the like is generally shorter than a retention time of normal paraffin having the same carbon number. In this case, therefore, assuming that the retention time of the isoparaffin is shorter than that of the normal paraffin having the same carbon number and is longer than that of normal paraffin having a carbon number smaller by one than that of the isoparaffin, the region of the retention time of the gas chromatography can be associated with the carbon number. Thus, a method of determining the average carbon chain length from an area ratio between the regions of the retention times in the gas chromatography can be used as another method.

($^{13}C$-NMR Measurement of Lubricant Base Oil)

A sample for the $^{13}C$-NMR measurement is prepared by charging a deuterated chloroform solution having a sample concentration of, for example, about 50% into a NMR sample tube of 10 mmϕ. By using DEPT (Distortionless Enhancement by Polarization Transfer) process can be determined that a chemical shift in the $^{13}C$-NMR measurement is assigned to any of CH carbon, $CH_2$ carbon or $CH_3$ carbon. Then, a quantitative measurement according to $^{1}H$-Gated Decoupling method removing NOE (Nuclear Overhauser Effect) is performed, from which a ratio of CH carbon, $CH_2$ carbon and $CH_3$ carbon can be determined.

(Method of Calculating an Average Branch Number of Lubricant Base Oil)

An average number of terminal carbons in one molecule of isoparaffin can be determined by multiplying the average carbon number Nc by the ratio of $CH_3$ carbon derived from the result of the $^{13}C$-NMR measurement. At this moment, the average branch number Nb in one molecule can be calculated assuming that the branch number in one isoparaffin molecule equals to a value obtained by subtracting 2 from the number of terminal carbons in one molecule.

(Average number of terminal carbons in one molecule)=(ratio of $CH_3$ carbon)×(average carbon number *Nc*)

(Average branch number *Nb* in one molecule)=(average number of terminal carbons in one molecule)−2

Alternatively, it can be determined from the following equations:

(Average number of branching carbons in one molecule)=(ratio of CH carbon)×(average carbon number *Nc*)

(Average branch number *Nb* in one molecule)=(Average number of branching carbons in one molecule)

EXAMPLES

The following examples are given in illustration of the invention and are not intended as limitations thereof.

Example 1

Fischer-Tropsch Synthetic Wax Used as a Starting Material

A starting wax A is a SX-60M made by SMDS (Shell Middle Distillate Synthesis) which is obtained by fractional distillation of a paraffin produced by a Fischer-Tropsch synthesis. A starting wax B used in a comparative example is a SX-50 made by SMDS (Shell Middle Distillate Synthesis). Main properties of these starting waxes are shown in Table 1.

TABLE 1

| | | Unit | Starting wax A | Starting wax B |
|---|---|---|---|---|
| Density (at 15° C.) | | $g/cm^3$ | 0.817 | 0.809 |
| Sulfur content | | wtppm | <1 | <1 |
| Nitrogen content | | wtppm | <1 | <1 |
| Normal paraffin in total | | wt % | 89.1 | 89.9 |
| C11-20 | | wt % | 0.8 | 2.8 |
| C21-30 | | wt % | 31.6 | 78.2 |
| C31-40 | | wt % | 49.5 | 8.9 |
| C41-50 | | wt % | 7.1 | 0 |
| C51-60 | | wt % | 0.1 | 0 |
| Average carbon number Nc | | | 29.0 | 23.8 |
| Distillation | IBP | ° C. | 343.0 | 316.0 |
| | 10% | ° C. | 401.0 | 379.0 |
| | 50% | ° C. | 474.0 | 416.5 |
| | 90% | ° C. | 524.5 | 456.5 |
| | FBP | ° C. | 580.5 | 488.5 |

(Catalyst for Isomerizing Fischer-Tropsch Synthetic Wax)

2000 g of alumina powder (Pural SB1 made by Condea) and 250 g of silica gel (Cariact G6 made by Fuji Silysia Chemical Co., Ltd.) are charged into a kneader and added and kneaded with 1 liter of 3.5% aqueous nitric acid as a peptizer for 30 minutes, and further added and kneaded with 40 g of mordenite (zeorite having a major axis of 7.0 Å and a $SiO_2/Al_2O_3$ molar ratio of 210, HSZ-690HOA made by Tosoh Co., Ltd.) for 30 minutes. The kneaded mass is shaped into a cylinder through an extruder provided with a die having a hole diameter of 1.4 mmϕ and dried at 130° C. for one night. The dried product is fired in a rotary kiln at 600° C. for 1 hour to obtain a catalyst carrier A.

Into 150 g of the catalyst carrier A are impregnated molybdenum, nickel and phosphorous by using an impregnation solution containing 46.5 g of ammonium molybdate, 41.8 g of nickel nitrate hexahydrate and 19.6 g of phosphoric acid solution. The thus impregnated carrier is dried at 130° C. for one night and then fired in a rotary kiln at 500° C. for 30 minutes to obtain a catalyst B.

The catalyst B comprises 5.0% by weight of silicon as metal element, 12.0% by weight of molybdenum as metal element, 4.4% by weight of nickel as metal element and 2.7% by weight of phosphorous as phosphorous element.

(Hydroisomerization of Fischer-Tropsch Synthetic Wax)

100 cc of the catalyst B sized into 10-14 mesh is weighed and filled in a fixed-bed fluid reactor having a length of 1260 mm and an inner diameter of 25 mm. Then, the temperature of the reactor is set at 300° C., and desulfurized diesel oil containing 1% by volume of carbon disulfide is flowed through the reactor for 24 hours to conduct a pre-sulfiding of the catalyst, and thereafter the starting wax A is flowed through the reactor under hydrogen flow to conduct hydroisomerization of the Fischer-Tropsch synthetic wax.

Moreover, the hydrogen gas used in the reaction has a purity of 99.99% by volume and a moisture of not more than 0.5 ppm by weight and contains other impurities that a concentration of sulfur compound is not more than 1 ppm by weight as converted into sulfur, a concentration of nitrogen compound is not more than 0.1 ppm by weight as converted into nitrogen, a concentration of oxygen compound other than water is not more than 0.1 ppm by weight as converted into oxygen, and a concentration of chlorine compound is not more than 0.1 ppm by weight as converted into chlorine.

The hydroisomerization of the starting wax A is conducted under conditions that the reaction temperature is 355° C., the reaction pressure (gauge pressure) is 5 MPa, LHSV is 1 $hr^{-1}$, and the hydrogen/oil ratio ($H_2$/oil) is 1500 NL/L. After it is ascertained that an activity of the hydroisomerization becomes sufficiently stabilized after 48 hours or more from the start of the feeding, the resulting oil P1 is collected. With respect to the oil P1, the distillation characteristics are evaluated by a distillation gas chromatography to calculate a decreasing ratio of a fraction having a boiling point of not lower than 360° C. The calculated decreasing ratio of a fraction having a boiling point of not lower than 360° C. in the oil P1 is 9.6% by weight.

(Dewaxing of Oil)

To 100 parts by weight of the collected oil P1 is added 400 parts by weight of a mixed solution of methyl ethyl ketone and toluene at a weight ratio of 1:1, which is held at 50° C. and sufficiently agitated and then cooled down to −29° C. The cooled slurry liquid is filtered under suction, and the resulting filtrate is distilled under a reduced pressure to remove methyl ethyl ketone and toluene, whereby there is obtained dewaxed oil DWO1.

(Fractional Distillation of Oil)

The dewaxed oil DWO1 is fractional-distilled through a TBP distillation apparatus to obtain lubricant base oil L1 containing a fraction having a boiling point of not lower than 360° C. As the TBP distillation apparatus is used PME-3010SR made by Tokaseiki Co., Ltd.

(NMR Analysis of Lubricant Base Oil L1)

The thus obtained lubricant base oil is subjected to $^{13}$C-NMR measurement. After it is determined that each of the peaks is assigned to any of CH carbon, $CH_2$ carbon and $CH_3$ carbon according to a DEPT (Distortionless Enhancement by Polarization Transfer) process, a quantitative measurement according to $^{1}$H-Gated Decoupling method removing NOE (Nuclear Overhauser Effect) is performed to identify each peak and calculate a ratio of carbons belonging to CH carbon, $CH_2$ carbon and $CH_3$ carbon.

(Analysis of Properties of Lubricant Base Oil L1)

The average carbon number of the lubricant base oil L1 is calculated by using the results of distillation characteristics measured by the distillation gas chromatography (ASTM D-2887). Also, kinematic viscosities at 40° C. and 100° C. and the pour point are measured, and further the viscosity index is calculated from the measured results of kinematic viscosities. The total amount of the normal paraffin and isoparaffin is 100% by weight in the lubricant base oil L1.

(Calculation of Average Branch Number of Lubricant Base Oil L1 Using Results of $^{13}$C-NMR Analysis)

Since the lubricant base oil obtained by dewaxing after the hydrocracking and isomerization of the Fischer-Tropsch synthetic wax consists essentially of isoparaffin, the average branch number in one molecule equals to a value obtained by subtracting 2 from the average number of $CH_3$ carbon in one molecule, so that the average branch number in one molecule is determined. The analytical results of the lubricant base oil L1 are shown in Table 2.

(Calculation of Average Carbon Number from the Distillation Characteristics)

The calculation of the average carbon number from the distillation characteristics is performed by using the analytical results of the distillation gas chromatography. The average carbon number is determined assuming that a peak between the retention time of $C_i$ normal paraffin and the retention time of $C_{i-1}$ normal paraffin is a peak of $C_i$ isoparaffin.

(Measurement of Contents of Normal Paraffin and Isoparaffin)

The measurement of normal paraffin content is carried out by a gas chromatography. Also, isoparaffin content (% by weight) is determined by subtracting the normal paraffin content (% by weight) from 100.

Example 2

The same starting wax A and catalyst B as in Example 1 are used for the isomerization. The same procedure as in Example 1 is repeated except that LHSV is 0.44 $hr^{-1}$ to obtain oil P2. The decreasing ratio of a fraction having a boiling point of not lower than 360° C. derived from analytical results of oil P2 by the distillation gas chromatography is 28.0% by weight. The oil P2 is dewaxed in the same manner as Example 1 to obtain dewaxed oil DWO2. The fraction having a boiling point of not lower than 360° C. is fractional-distilled from the dewaxed oil DWO2 through a TBP distillation apparatus to obtain lubricant base oil L2. The analytical results of the lubricant base oil L2 about the same items as in Example 1 are shown in Table 2. The total content of normal paraffin and isoparaffin is 100% by weight.

Example 3

First Hydroisomerization of Fischer-Tropsch Synthetic Wax 100 cc of the catalyst B sized into 10-14 mesh is weighed and filled in a fixed-bed fluid reactor having a length of 1260 mm and an inner diameter of 25 mm. Then, the temperature of the reactor is set at 300° C., and desulfurized diesel oil containing 1% by volume of carbon disulfide is flowed through the reactor for 24 hours to conduct a preliminary desulfurization of the catalyst, and thereafter the starting wax A is flowed through the reactor under hydrogen flow to conduct the hydrocracking of the Fischer-Tropsch synthetic wax.

Moreover, the hydrogen gas used in the reaction has a purity of 99.99% by volume and a moisture of not more than 0.5 ppm by weight and contains other impurities that a concentration of sulfur compound is not more than 1 ppm by weight as converted into sulfur, a concentration of nitrogen compound is not more than 0.1 ppm by weight as converted into nitrogen, a concentration of oxygen compound other than water is not more than 0.1 ppm by weight as converted into oxygen, and a concentration of chlorine compound is not more than 0.1 ppm by weight as converted into chlorine.

The hydrocracking of the starting wax A is conducted under conditions that the reaction temperature is 355° C., the reaction pressure (gauge pressure) is 5 MPa, LHSV is 0.44 $hr^{-1}$, the hydrogen/oil ratio ($H_2$/oil) is 1500 NL/L. After it is ascertained that an activity of the hydroisomerization becomes sufficiently stabilized after 48 hours or more from the start of the feeding, the resulting oil P3 is collected. With respect to the oil P3, the distillation characteristics are evaluated by a distillation gas chromatography to calculate a decreasing ratio of a fraction having a boiling point of not lower than 360° C. The calculated decreasing ratio of a fraction having a boiling point of not lower than 360° C. in the oil P3 is 9.6% by weight. The average carbon number of the fraction having a boiling point of not lower than 360° C. in the oil P3 is 29.1.

(Isolation of Normal paraffin from Oil)

To 100 parts by weight of the oil P3 is added 400 parts by weight of a mixed solution of methyl ethyl ketone and toluene at a weight ratio of 1:1, which is held at 50° C. and sufficiently agitated and cooled down to −29° C. The cooled slurry liquid is filtered under suction, and the resulting filtrate is distilled under a reduced pressure to remove methyl ethyl ketone and toluene to thereby obtain dewaxed oil DWO3. Also, the residual solid after the filtration is distilled under a reduced pressure to remove methyl ethyl ketone and toluene to thereby obtain a normal paraffin NP1.

(Second Hydroisomerization of Fischer-Tropsch Synthetic Wax)

The hydroisomerization of the isolated normal paraffin NP1 as a starting material is conducted under conditions that the reaction temperature is 340° C., the reaction pressure (gauge pressure) is 5 MPa, LHSV is 0.44 $hr^{-1}$, the hydrogen/oil ratio ($H_2$/oil) is 1500 NL/L to obtain oil P4. The distillation characteristics of the oil P4 are evaluated by the distillation gas chromatography to calculate the decreasing ratio of a fraction having a boiling point of not lower than 360° C. The calculated decreasing ratio of the fraction having a boiling point of not lower than 360° C. in the oil P4 is 14.3% by weight.

(Dewaxing of Normal Paraffin in Oil)

The dewaxed oil DWO3 and the oil P4 are mixed to obtain mixed oil M1. To 100 parts by weight of the mixed oil M1 is added 400 parts by weight of a mixed solution of methyl ethyl ketone and toluene at a weight ratio of 1:1, which is held at 50° C. and sufficiently agitated and cooled down to −29° C. The cooled slurry liquid is filtered under suction, and the resulting filtrate is distilled under a reduced pressure to remove methyl ethyl ketone and toluene to thereby obtain dewaxed oil DWO4.

(Fractional Distillation of Oil)

The dewaxed oil DWO4 is fractional-distilled through a TBP distillation apparatus to obtain lubricant base oil L3 containing a fraction having a boiling point of not lower than 360° C. The yield of the lubricant base oil L3 is 56.0% when the starting wax A is 100% by weight.

(Analysis of Characteristics of Lubricant Base Oil L3)

The kinematic viscosities at 40° C. and 100° C. and the pour point of the lubricant base oil L3 are measured, and the viscosity index is calculated from the measured results of the kinematic viscosities.

Comparative Example 1

The same starting wax A and catalyst B as used in Example 1 are used for the isomerization. The same procedure as in Example 1 is repeated except that LHSV is 0.33 $hr^{-1}$ to obtain oil P4. The decreasing ratio of a fraction having a boiling point of not lower than 360° C. derived from the results of the distillation characteristics of the oil P4 is 46.6% by weight. The fraction having a boiling point of not lower than 360° C. is fractional-distilled from the oil P4 through the TBP distillation apparatus to obtain lubricant base oil L4. The analytical results of the lubricant base oil L4 about the same items as in Example 1 are shown in Table 2. The total content of normal paraffin and isoparaffin is 100% by weight.

Comparative Example 2

As a starting wax is used a wax B having an average carbon number smaller than that of the wax A and the catalyst B is used for the isomerization. The characteristics of the wax B are shown in Table 1. The hydroisomerization of the starting wax B is conducted under conditions that the reaction temperature is 370° C., the reaction pressure (gauge pressure) is 4 MPa, LHSV is 1 $hr^{-1}$, the hydrogen/oil ratio ($H_2$/oil) is 660 NL/L. After it is ascertained that an activity of the hydroisomerization becomes sufficiently stabilized after 48 hours or more from the start of the feeding, the resulting oil P5 is collected. The decreasing ratio of a fraction having a boiling point of not lower than 360° C. calculated from the analytical results of the oil P5 by the distillation gas chromatography is 83.5% by weight.

The oil P5 is dewaxed in the same manner as in Example 1 to obtain dewaxed oil DWO5. The fraction having a boiling point of not lower than 360° C. is fractional-distilled from the dewaxed oil DWO5 through the TBP distillation apparatus to obtain lubricant base oil L5. The analytical results of the lubricant base oil L5 about the same items as in Example 1 are shown in Table 2. The total content of normal paraffin and isoparaffin is 100% by weight.

TABLE 2

| | Unit | Example 1 Lubricant base oil L1 | Example 2 Lubricant base oil L2 | Example 3 Lubricant base oil L3 | Comparative Example 1 Lubricant base oil L4 | Comparative Example 2 Lubricant base oil L5 |
|---|---|---|---|---|---|---|
| Kinematic Viscosity at 40° C. | $mm^2/s$ | 17.57 | 17.66 | 17.10 | 16.86 | 11.27 |
| Kinematic Viscosity at 100° C. | $mm^2/s$ | 4.289 | 4.190 | 4.171 | 3.980 | 2.943 |
| Viscosity index | — | 159 | 147 | 154 | 137 | 114 |
| Pour point | ° C. | −15.0 | −12.5 | −15.0 | 2.5 | −22.5 |

TABLE 2-continued

| | Unit | Example 1 Lubricant base oil L1 | Example 2 Lubricant base oil L2 | Example 3 Lubricant base oil L3 | Comparative Example 1 Lubricant base oil L4 | Comparative Example 2 Lubricant base oil L5 |
|---|---|---|---|---|---|---|
| Ratio of $CH_3$ carbon from $^{13}C$-NMR analysis | % | 14.2 | 15.2 | 14.8 | 16.8 | 18.7 |
| Ratio of $CH_2$ carbon from $^{13}C$-NMR analysis | % | 77.8 | 75.8 | 77.2 | 73.5 | 71.5 |
| Ratio of CH carbon from $^{13}C$-NMR analysis | % | 8.0 | 9.0 | 8.0 | 9.6 | 18.7 |
| Average carbon number from distillation | number | 30.6 | 29.2 | 30.1 | 28.2 | 24.4 |
| Average branch number | number | 2.27 | 2.44 | 2.45 | 2.74 | 2.57 |
| Yield of lubricant base oil | wt % | 29.6 | 41.5 | 56.0 | 50.5 | 15.9 |

INDUSTRIAL APPLICABILITY

According to the invention, the high quality lubricant base oil can be produced in a high yield by using the starting straight-chain hydrocarbon material such as Fischer-Tropsch synthetic wax or the like. Also, the lubricant base oil having a high viscosity index and a low pour point, which are not attained in the conventional technique, can be obtained in a high yield by controlling the average carbon number and the average branch number in one molecule of hydrocarbons constituting the lubricant base oil to given ranges. Furthermore, when the wax component such as Fischer-Tropsch synthetic wax is used as a starting material, the resulting lubricant base oil simultaneously establishes high performances and reduction of environmental burden because it does not contain environmental pollutants such as sulfur content, aromatic content and the like, so that it is expected that the demand thereof will increase in the future.

What is claimed is:

1. Lubricant base oil consisting essentially of a normal paraffin and an isoparaffin, and satisfying the following requirements (a), (b) and (c):

(a) an average carbon number Nc in one molecule is not less than 29 but not more than 35;

(b) an average branch number Nb in one molecule, which is derived from a ratio of $CH_3$ carbon to total carbon determined by $^{13}C$-NMR analysis and the average carbon number Nc in one molecule, is not more than (0.2Nc−3.1) but not less than 1.5; and (c) a viscosity index is 145-170 and a kinematic viscosity at 40° C. is 17-25 $mm^2/s$.

2. Lubricant base oil according to claim 1, which is obtained from an isomerization of a starting straight-chain hydrocarbon material having an average carbon number Nc in one molecule of not less than 25.

3. Lubricant base oil according to claim 2, wherein the starting straight-chain hydrocarbon material is a Fischer-Tropsch synthetic wax.

4. A method of producing the lubricant base oil of claim 3, which comprises subjecting starting oil composed of a Fischer-Tropsch synthetic wax having a 10% distillation temperature of not lower than 360° C. to an isomerization under a condition that a decreasing ratio of a fraction having a boiling point of not lower than 360° C. is not more than 40% by weight.

5. A method of producing the lubricant base oil of claim 1, which comprises:

(1) hydroisomerizing a starting straight-chain hydrocarbon material in a first reactor;

(2) separating oil obtained by the hydroisomerization into a fraction mainly composed of a normal paraffin (fraction α) and a fraction mainly composed of an isoparaffin (fraction β);

(3) hydroisomerizing the fraction α in a second reactor, and mixing oil obtained from the hydroisomerization (fraction γ) with the fraction β.

6. A method according to claim 5, wherein the hydroisomerization in the second reactor is carried out under a reaction condition that a decreasing ratio of a fraction having a boiling point of not lower than 360° C. in the hydroisomerization at the second reactor is lower than a decreasing ratio of a fraction having a boiling point of not lower than 360° C. in the hydroisomerization at the first reactor.

7. A method according to claim 5, wherein the starting straight-chain hydrocarbon material is a Fischer-Tropsch synthetic wax.

8. A method according to claim 7, wherein the Fischer-Tropsch synthetic wax has an average carbon number Nc of not less than 25.

9. A method according to claim 5, wherein the hydroisomerization in the first reactor is carried out under a reaction condition that a decreasing ratio of a fraction having a boiling point of not lower than 360° C. is not more than 50% by weight.

10. A method of producing the lubricant base oil of claim 2, which comprises:

(1) hydroisomerizing a starting straight-chain hydrocarbon material in a first reactor;

(2) separating oil obtained by the hydroisomerization into a fraction mainly composed of a normal paraffin (fraction α) and a fraction mainly composed of an isoparaffin (fraction β);

(3) hydroisomerizing the fraction α in a second reactor, and mixing oil obtained from the hydroisomerization (fraction γ) with the fraction β.

11. A method of producing the lubricant base oil of claim 3, which comprises:

(1) hydroisomerizing a starting straight-chain hydrocarbon material in a first reactor;

(2) separating oil obtained by the hydroisomerization into a fraction mainly composed of a normal paraffin (fraction α) and a fraction mainly composed of an isoparaffin (fraction β);

(3) hydroisomerizing the fraction α in a second reactor, and mixing oil obtained from the hydroisomerization (fraction γ) with the fraction β.

12. A method according to claim 10, wherein the hydroisomerization in the second reactor is carried out under a reaction condition that a decreasing ratio of a fraction having a boiling point of not lower than 360° C. in the hydroisomerization at the second reactor is lower than a decreasing ratio of a fraction having a boiling point of not lower than 360° C. in the hydroisomerization at the first reactor.

13. A method according to claim 11, wherein the hydroisomerization in the second reactor is carried out under a reaction condition that a decreasing ratio of a fraction having a boiling point of not lower than 360° C. in the hydroisomerization at the second reactor is lower than a decreasing ratio of a fraction having a boiling point of not lower than 360° C. in the hydroisomerization at the first reactor.

14. A method according to claim 10, wherein the starting straight-chain hydrocarbon material is a Fischer-Tropsch synthetic wax.

15. A method according to claim 11, wherein the starting straight-chain hydrocarbon material is a Fischer-Tropsch synthetic wax.

16. A method according to claim 14, wherein the Fischer-Tropsch synthetic wax has an average carbon number Nc of not less than 25.

17. A method according to claim 15, wherein the Fischer-Tropsch synthetic wax has an average carbon number Nc of not less than 25.

18. A method according to claim 10, wherein the hydroisomerization in the first reactor is carried out under a reaction condition that a decreasing ratio of a fraction having a boiling point of not lower than 360° C. is not more than 50% by weight.

19. A method according to claim 11, wherein the hydroisomerization in the first reactor is carried out under a reaction condition that a decreasing ratio of a fraction having a boiling point of not lower than 360° C. is not more than 50% by weight.

20. Lubricant base oil according to claim 1, wherein the lubricant base oil further satisfies: (d) a pour point of the lubricant base oil is between −10° C. to −40° C.

* * * * *